US008550783B2

(12) United States Patent
Dietrich et al.

(10) Patent No.: US 8,550,783 B2
(45) Date of Patent: Oct. 8, 2013

(54) TURBINE BLADE PLATFORM UNDERCUT

(75) Inventors: Douglas James Dietrich, West Palm Beach, FL (US); Stephen Wayne Fiebiger, Jupiter, FL (US); Gregory Edwin Vogel, Palm Beach Gardens, FL (US)

(73) Assignee: Alstom Technology Ltd., Baden (CH)

( * ) Notice: Subject to any disclaimer, the term of this patent is extended or adjusted under 35 U.S.C. 154(b) by 369 days.

(21) Appl. No.: 13/078,664

(22) Filed: Apr. 1, 2011

(65) Prior Publication Data

US 2012/0251331 A1 Oct. 4, 2012

(51) Int. Cl.
*F01D 5/30* (2006.01)

(52) U.S. Cl.
USPC ..... 416/193 A; 416/239

(58) Field of Classification Search
USPC ..... 416/96 R, 193 A, 239
See application file for complete search history.

(56) References Cited

U.S. PATENT DOCUMENTS

| | | | | |
|---|---|---|---|---|
| 835,473 | A | 11/1906 | Rotter | |
| 2,974,924 | A * | 3/1961 | Rankin et al. | 415/173.7 |
| 4,365,933 | A | 12/1982 | Langer | |
| 5,387,086 | A | 2/1995 | Frey | |
| 5,947,687 | A | 9/1999 | Mori et al. | |
| 6,092,983 | A | 7/2000 | Tomita | |
| 6,120,249 | A | 9/2000 | Hultgren | |
| 6,390,775 | B1 | 5/2002 | Paz | |
| 6,481,967 | B2 | 11/2002 | Tomita et al. | |
| 6,761,536 | B1 * | 7/2004 | Bash et al. | 416/193 A |
| 6,951,447 | B2 * | 10/2005 | Cherolis et al. | 416/193 A |
| 6,984,112 | B2 | 1/2006 | Zhang et al. | |
| 7,147,440 | B2 | 12/2006 | Benjamin et al. | |
| 7,399,163 | B2 | 7/2008 | Bil et al. | |
| 7,497,661 | B2 | 3/2009 | Boury et al. | |
| 7,762,780 | B2 | 7/2010 | Decardenas | |
| 2002/0076324 | A1 | 6/2002 | Abuaf | |
| 2004/0213672 | A1 * | 10/2004 | Gautreau et al. | 416/190 |
| 2005/0058545 | A1 * | 3/2005 | Cardenas | 416/97 R |
| 2005/0135936 | A1 * | 6/2005 | Cherolis et al. | 416/193 A |
| 2006/0269409 | A1 * | 11/2006 | Torii et al. | 416/97 R |
| 2007/0269313 | A1 * | 11/2007 | Nadvit et al. | 416/193 A |
| 2008/0181784 | A1 * | 7/2008 | Fokine et al. | 416/97 R |
| 2010/0129228 | A1 | 5/2010 | Strohl | |

FOREIGN PATENT DOCUMENTS

| | | |
|---|---|---|
| DE | 102009025814 | 12/2009 |
| EP | 0851097 | 7/1998 |
| EP | 0875665 | 11/1998 |
| EP | 0937863 | 8/1999 |

(Continued)

OTHER PUBLICATIONS

International Search Report and Written Opinion of PCT/US2012/031234; dated Aug. 21, 2012.

(Continued)

*Primary Examiner* — Edward Look
*Assistant Examiner* — Aaron R Eastman
(74) *Attorney, Agent, or Firm* — Shook, Hardy & Bacon L.L.P.

(57) ABSTRACT

A system and method of extending the useable life of a gas turbine blade is disclosed in which the gas turbine blade includes an undercut configuration designed to relieve mechanical and thermal stress imparted into the pedestal region of the airfoil trailing edge. The embodiments of the present invention include turbine blade configurations having different trailing edge undercut configurations as well as additional cooling supplied to the internal passages of the trailing edge region of the turbine blade.

14 Claims, 9 Drawing Sheets

(56) References Cited

FOREIGN PATENT DOCUMENTS

| | | |
|---|---|---|
| EP | 1128024 | 8/2001 |
| EP | 1514999 | 3/2005 |
| EP | 1544410 | 6/2005 |
| EP | 1630351 | 3/2006 |
| GB | 1190771 | 5/1970 |
| JP | 07332004 | 12/1995 |

OTHER PUBLICATIONS

European Search Report of 04077020; dated Nov. 14, 2006.
European Search Report of 04257869; dated Mar. 3, 2005.
European Search Report of 05291725; dated Nov. 14, 2005.

* cited by examiner

TURBINE BLADE PLATFORM UNDERCUT

CROSS-REFERENCE TO RELATED APPLICATIONS

Not applicable.

TECHNICAL FIELD

The present invention relates to gas turbine engines. More particularly, embodiments of the present invention relate to a gas turbine blade having one or more undercuts formed in the platform to relieve mechanical and thermal stresses in the airfoil trailing edge and increased cooling to the trailing edge region of the turbine blade.

BACKGROUND OF THE INVENTION

A gas turbine engine operates to produce mechanical work or thrust. For a land-based gas turbine engine, a generator is typically coupled to the engine through an axial shaft, such that the mechanical work of the engine is harnessed to generate electricity. A typical gas turbine engine comprises a compressor, at least one combustor, and a turbine, with the compressor and turbine coupled together through the axial shaft. In operation, as air passes through multiple stages of axially-spaced rotating blades and stationary vanes of the compressor, its pressure increases. The compressed air is then mixed with fuel in the combustion section, which can comprise one or more combustion chambers. The fuel and air mixture is ignited in the combustion chamber, producing hot combustion gases, which pass into the turbine causing the turbine to rotate. The turning of the shaft also drives the generator.

The turbine comprises a plurality of rotating and stationary stages of airfoils. Due to the high temperatures experienced by the turbine components, it is necessary to provide cooling throughout the turbine airfoil. To most efficiently use the available cooling air, turbine blades often have a serpentine-like flow path through the interior of the turbine blade that extends to the blade tip and/or the trailing edge of the blade. Cooling air is then ejected through a plurality of slots in the trailing edge. Actively cooling this region is necessary because the trailing edge is the thinnest portion of the airfoil and most subject to erosion and thermal damage due to the elevated temperatures. Also, because the airfoil trailing edge is one of the thinnest regions of the airfoil, it is also a well-known location for crack initiation due to the high thermal and mechanical stresses imparted to the area. Specifically, the pedestals positioned proximate the trailing edge are a known source of crack initiation, and cracks in these areas can lead to failure of the turbine blade.

SUMMARY

Embodiments of the present invention are directed towards a gas turbine blade having an undercut configuration designed to relieve mechanical and thermal stresses imparted into the lower region of the airfoil trailing edge. The embodiments of the present invention include turbine blade configurations having different trailing edge undercut configurations as well as additional cooling supplied to the internal passages of the turbine blade.

In an embodiment of the present invention, a gas turbine blade having a plurality of undercuts positioned along the trailing edge of the turbine blade is disclosed. The undercuts extend from a pressure side face of the platform to a suction side face of the platform and the trailing edge face of the platform and intersect in a region adjacent the trailing edge of the airfoil.

In an alternate embodiment of the present invention, a gas turbine blade having a root, a shank extending radially outward from the root, a platform extending radially outward from the shank, an airfoil extending radially outward from the platform, and a compound-shaped undercut extending between a pressure side face and the suction side face and extending to a trailing edge face of the platform is disclosed.

In another embodiment of the present invention, a gas turbine blade comprises a root, a platform, and an airfoil having at least a serpentine passageway comprising a first passage, second passage, and a third passage. A first supply passage is in fluid communication with the first passage, and a second supply passage in fluid communication with the second and third passages. A first undercut is positioned along the pressure side face of the platform and extends to the trailing edge face of the platform and a second undercut is positioned along the suction side face and also extends to the trailing edge face of the platform, intersecting the first undercut.

Additional advantages and features of the present invention will be set forth in part in a description which follows, and in part will become apparent to those skilled in the art upon examination of the following, or may be learned from practice of the invention.

BRIEF DESCRIPTION OF THE SEVERAL VIEWS OF THE DRAWINGS

The present invention is described in detail below with reference to the attached drawing figures, wherein.

DETAILED DESCRIPTION

The subject matter of the present invention is described with specificity herein to meet statutory requirements. However, the description itself is not intended to limit the scope of this patent. Rather, the inventors have contemplated that the claimed subject matter might also be embodied in other ways, to include different components, combinations of components, steps, or combinations of steps similar to the ones described in this document, in conjunction with other present or future technologies.

It is well known that high temperatures, pressures, and vibratory conditions present in a gas turbine engine can cause cracks in various components such as turbine blades, vanes, and combustion components. Depending on the location of the cracks, the turbine blade can actually fail and pass downstream through the turbine, causing extensive damage to the gas turbine engine.

Figure 2:
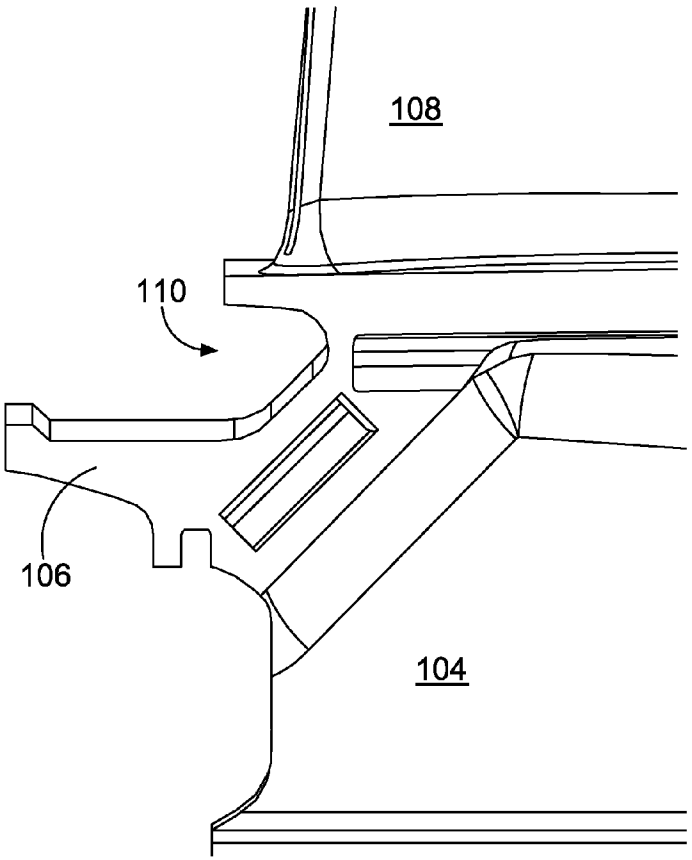
FIG. 2 PRIOR ART
FIG. 2 depicts a detailed side elevation view of a portion of the turbine blade of FIG. 1 of the prior art.
Figure 1:
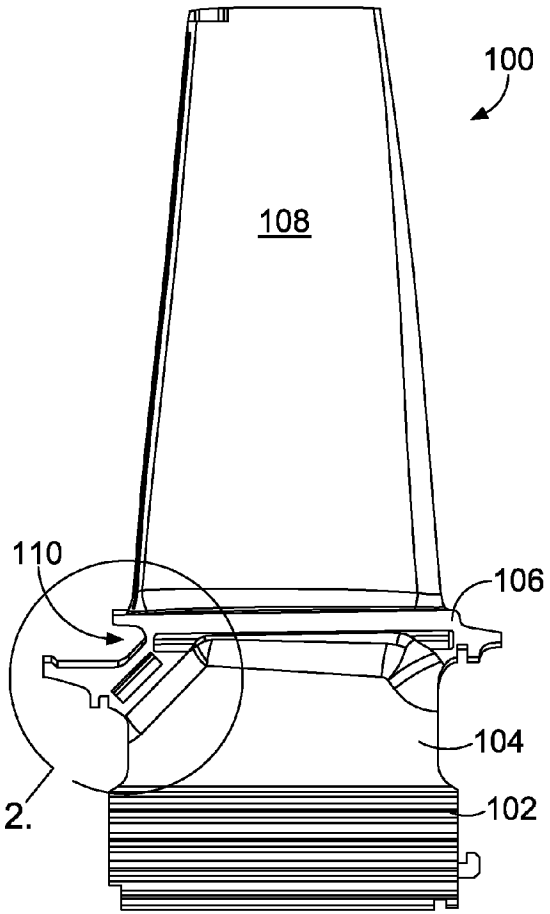
FIG. 1 PRIOR ART
FIG. 1 depicts a side elevation view of a turbine blade of the prior art.
Figure 3:
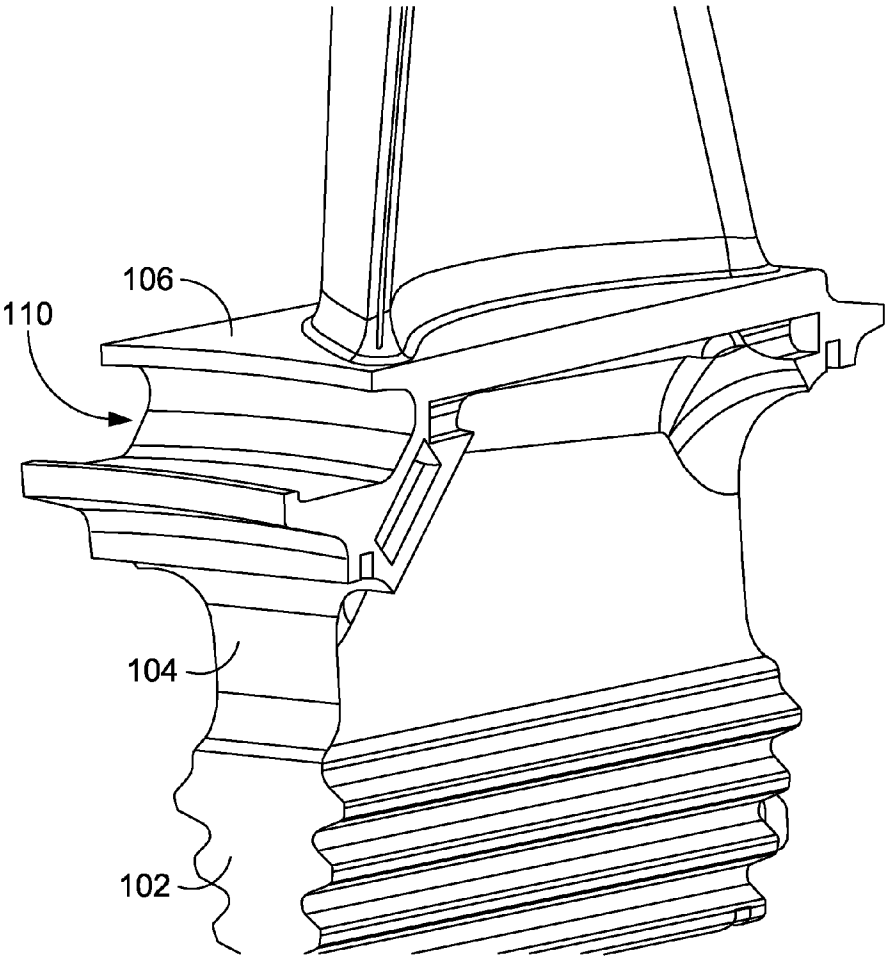
FIG. 3 PRIOR ART
FIG. 3 depicts a perspective view of the trailing edge of the platform of the turbine blade of FIG. 1 of the prior art.
Figure 5:
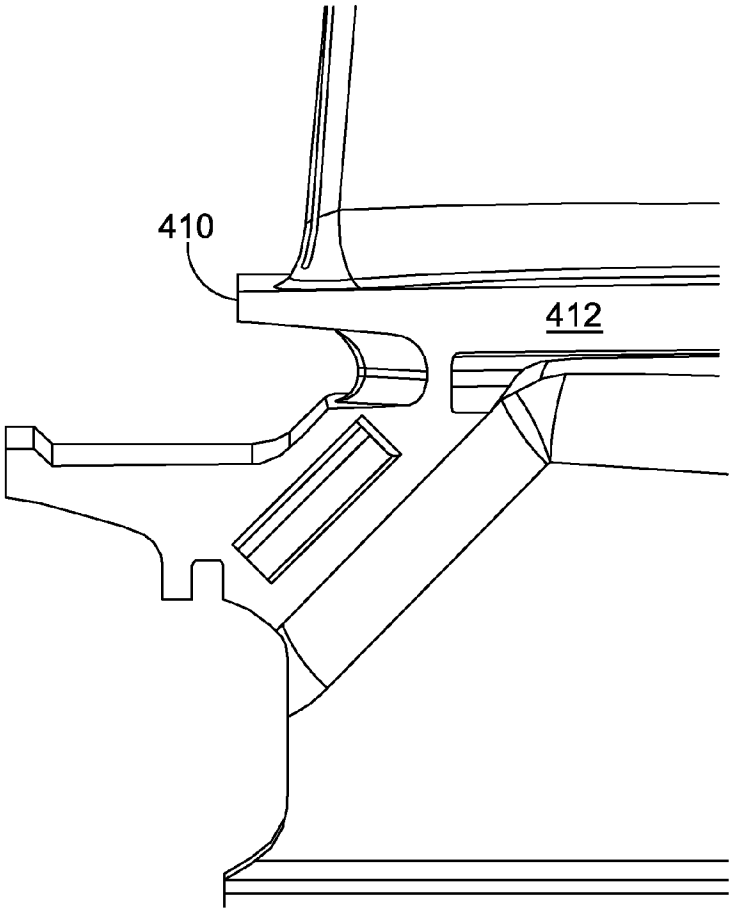
FIG. 5 depicts a detailed side elevation view of a portion of the turbine blade of FIG. 4 in accordance with an embodiment of the present invention.
Figure 4:
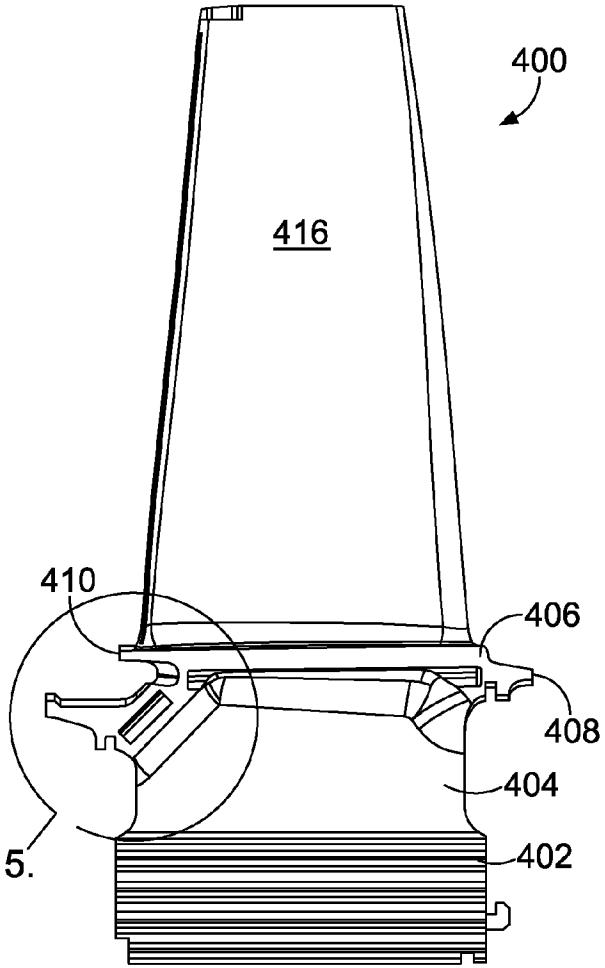
FIG. 4 depicts a side elevation view of a turbine blade in accordance with an embodiment of the present invention.

Configurations of the prior art blade having a traditional trailing edge undercut are shown in FIGS. 1-3. The turbine blade 100 incorporates a root 102, shank 104, platform 106, and an airfoil 108. The turbine blade 100 also includes an undercut 110 extending along a portion of the platform 106. The undercut 110 extends across the width of the platform 106, as shown in FIG. 3. The undercut 110 serves to relieve the mechanical stresses in the trailing edge of the airfoil 108. The embodiment disclosed in FIGS. 1-3, while attempting to reduce the mechanical load to the airfoil, does not adequately relieve the mechanical stresses nor the thermal stresses caused by the temperature gradient, and as a result, the trailing edge of the airfoil 108 has been known to crack and cause failure of the turbine blade.

Figure 6:
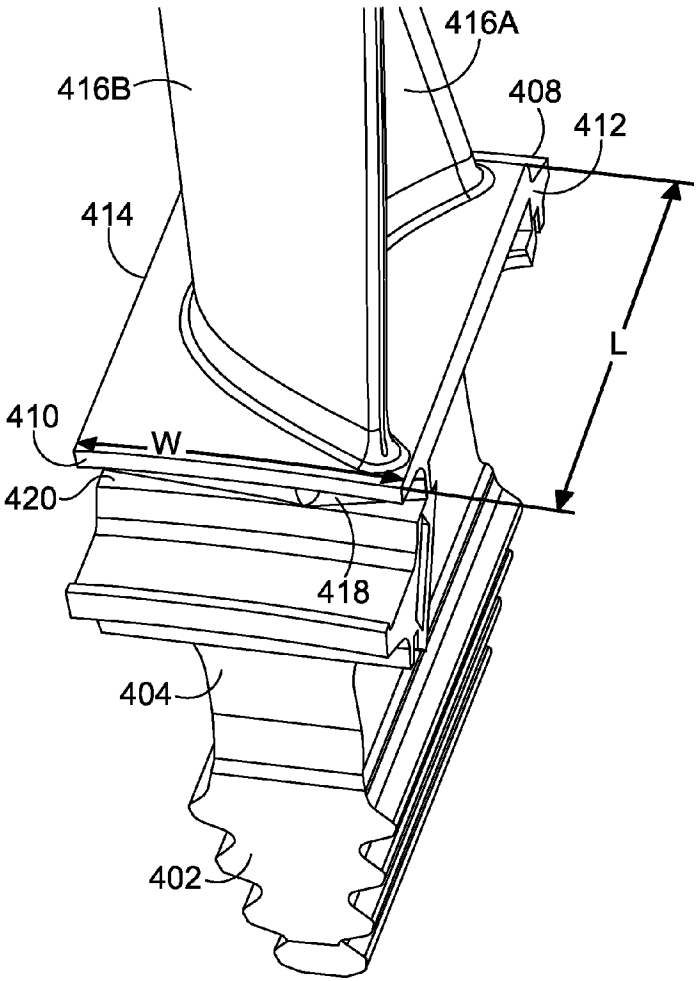
FIG. 6 depicts a view of the trailing edge of the platform of the turbine blade of FIG. 4 in accordance with an embodiment of the present invention.

Embodiments of the present invention are shown in FIGS. 4-12. Although various forms of a platform undercut are shown with respect to one type of turbine blade, it is Applicant's intent that the present invention of a platform undercut can be incorporated into a variety of turbine blade designs. A turbine blade 400 comprises a root 402, a shank 404 extending radially outward from the root 402, and a platform 406 extending radially outward from the shank 404. The platform 406 has an opposing leading edge face 408 and trailing edge face 410 separated by a length L, a pressure side face 412, and an opposing suction side face 414 that are separated by a width W (as shown in FIG. 6). The turbine blade 400 also includes an airfoil 416 extending radially outward from the platform 406.

Figure 7:
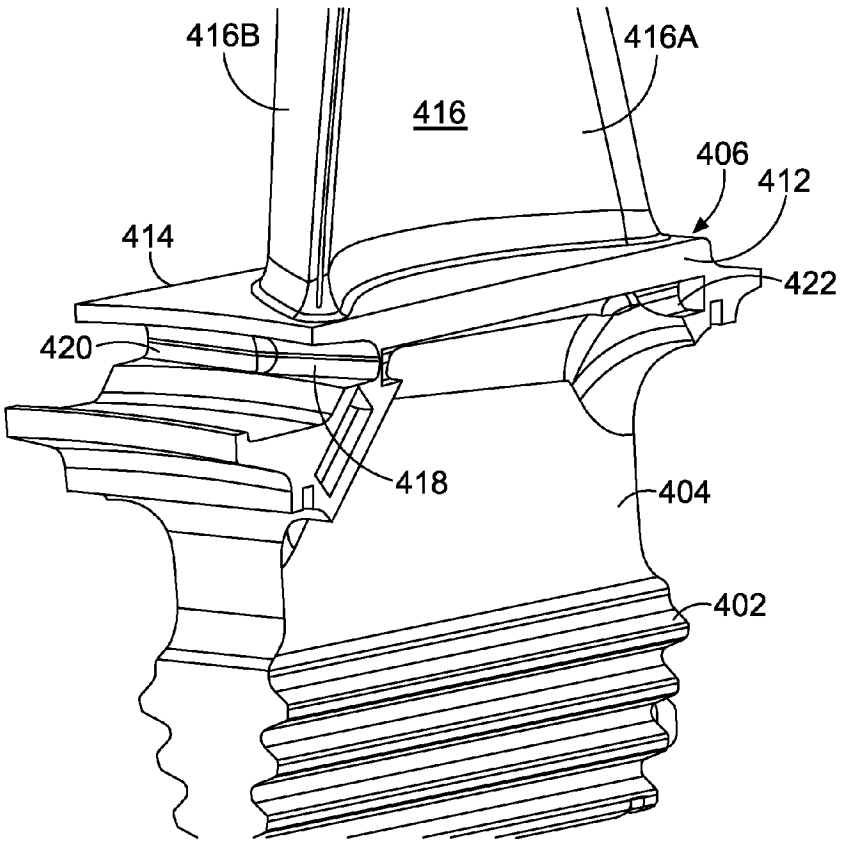
FIG. 7 depicts a perspective view of the trailing edge of the platform of the turbine blade of FIG. 4 in accordance with an embodiment of the present invention.

As depicted in FIG. 7, the pressure side face 412 of the platform 406 is proximate a concave surface 416A of airfoil 416 and generally referred to as a pressure side because of the higher air pressure present along the concave side of an airfoil, as opposed to along a convex surface 416B of the airfoil 416. The suction side face 414 of the platform 406 is proximate the convex surface 416B.

Referring to FIGS. 6-9, the platform 406 also includes a first undercut 418 positioned along the pressure side face 412 and extending to the trailing edge face 410 of the platform 406. The platform 406 also includes a second undercut 420 positioned along the suction side face 414, extending to the trailing edge face 410 of the platform 406, and intersecting with the first undercut 418. By incorporating two angled undercuts into the platform 406, the overall size of the undercut can be increased, which results in further reducing the mechanical loading and thermal stresses to the airfoil trailing edge adjacent the platform.

Figure 9:
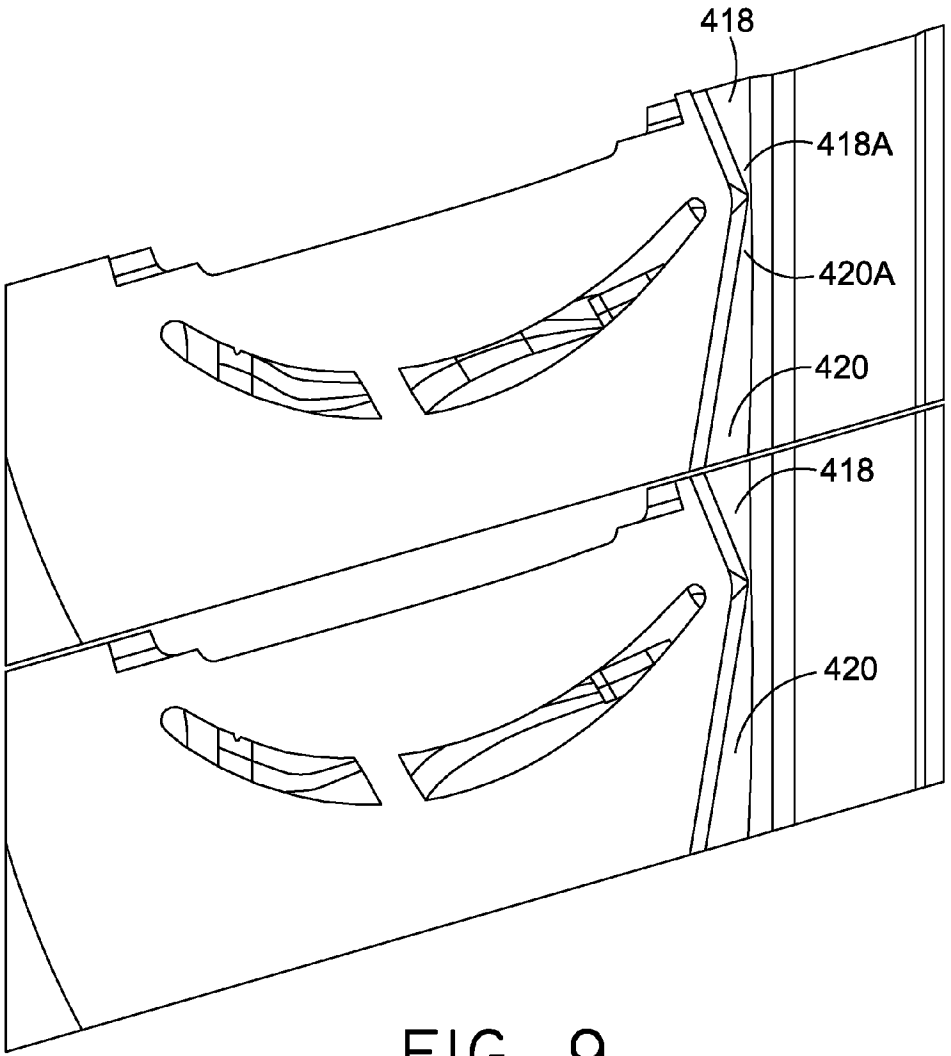
FIG. 9 depicts a cross section view taken through the platforms of adjacent turbine blades in accordance with an embodiment of the present invention.

The configuration of the two undercuts 418 and 420 is generally determined based on the orientation of the airfoil 416 and any platform sealing devices. More specifically, the angle of the first undercut 418 is determined based on the depth necessary for the undercut to extend beneath the trailing edge of the airfoil 416. However, in turbine blades that utilize a platform seal between mating turbine blades (to prevent air leakage), it is also necessary to size the undercut to conform to a recessed region 422, which contains a platform seal. For an embodiment of the present invention, the first undercut 418 has a first cut angle 418A, where the first cut angle 418A originates at the intersection of the first undercut 418 and second undercut 420. An embodiment of the present invention, as shown in FIG. 9, incorporates a first cut angle 418A of approximately 20-25 degrees. The first undercut 418 is not limited to this range, but is sized so as to sufficiently extend under the trailing edge of the airfoil 416.

Figure 8:
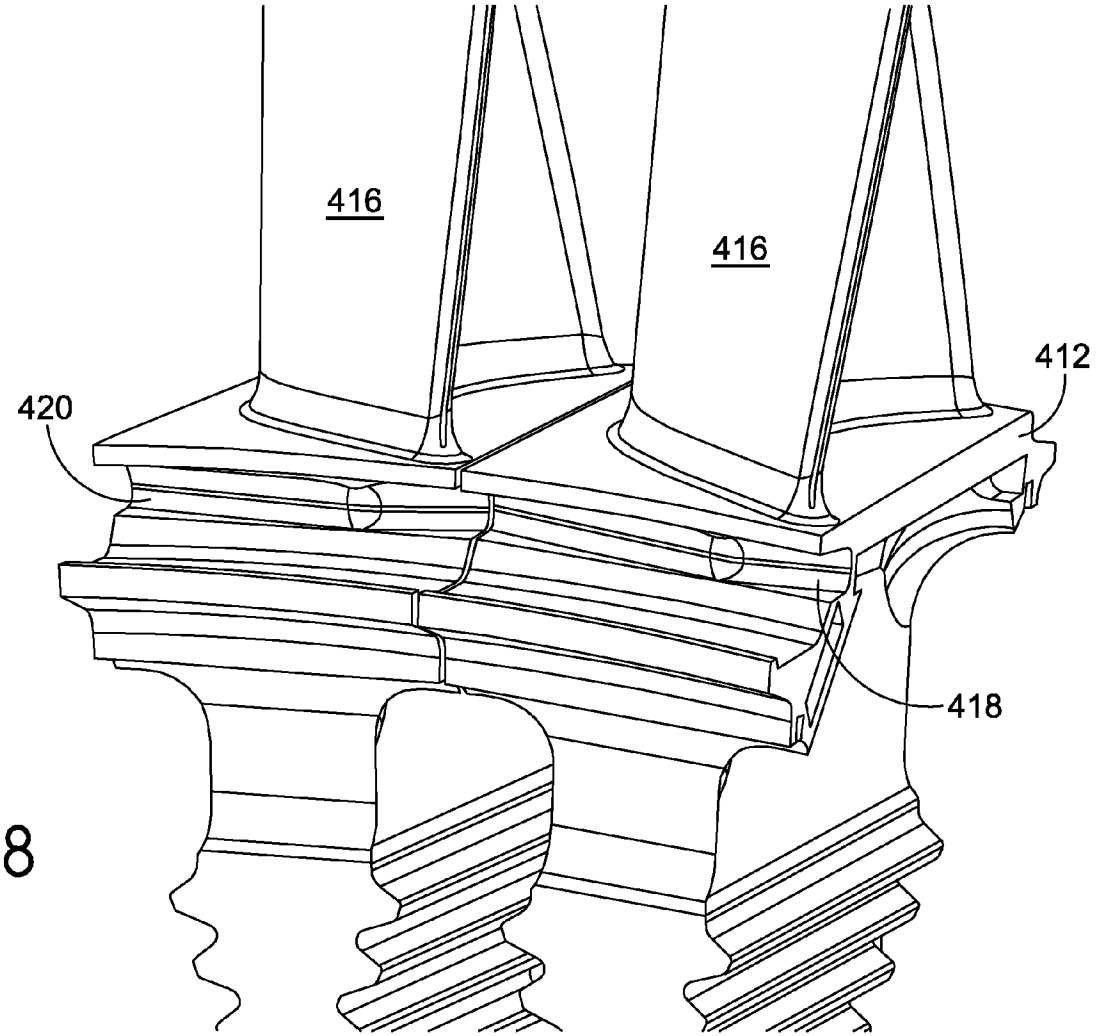
FIG. 8 depicts a perspective view of the trailing edge of the platforms of adjacent turbine blades in accordance with an embodiment of the present invention.

The second undercut 420 is then determined based on the size of the first undercut 418 such that when adjacent turbine blades are installed in a rotor disk, the edge of the first undercut 418 along pressure side face 412 generally aligns with the edge of the second undercut 420 along the suction side face 414, as shown in FIGS. 8 and 9. For the embodiment discussed above, a second cut angle 420A would be approximately 5-15 degrees. The alignment of the breakout of the two undercuts serves to reduce any windage effects occurring between adjacent turbine blades.

While the undercuts 418 and 420 are necessary to relieve mechanical and thermal stresses in the trailing edge of the airfoil 416, the undercuts must also remain a sufficient distance from the internal cooling air passage so as to not reduce its structural integrity. Therefore, in an embodiment of the invention the minimum distance between the undercuts 418 and 420 and the internal cooling air passage is approximately 0.125 inches. This minimum wall thickness will generally occur at the intersection of the first undercut 418 with the second undercut 420.

Figure 11:
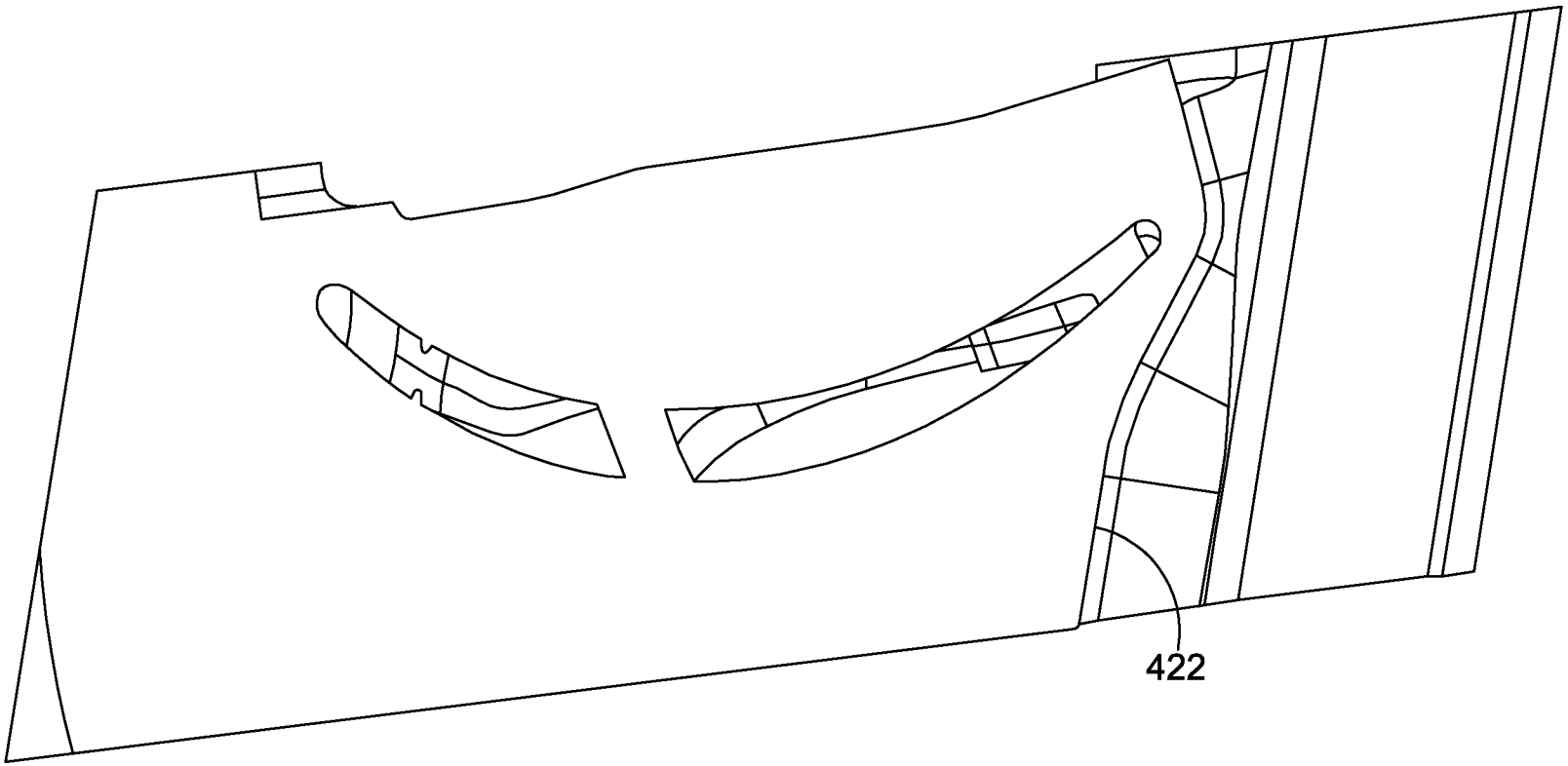
FIG. 11 depicts a cross section view taken through the platform of a turbine blade in accordance with an alternate embodiment of the present invention; and, FIG. 12 depicts an internal view of the turbine blade of FIG. 4 showing the cooling passages within the turbine blade in accordance with an embodiment of the present invention.

A variety of techniques can be used to incorporate the undercuts into the platform 406. If the undercuts are being incorporated into an existing turbine blade as a modification, they can be machined into the part through a milling or other machining process. This is the general configuration discussed above and depicted in FIGS. 4-9. In an alternate embodiment of the present invention, the undercuts can have a compound shape, including having a smooth curve 422, as depicted in FIG. 11. This compound shape can be incorporated into an existing turbine blade, through a machining process, such as electrical discharge machining (EDM) and a shaped electrode. The compound shape undercut can be incorporated into the blade by casting the blade and platform with the desired undercut through a change in the casting mold. By casting the undercuts into the platform 406, a more detailed and optimized undercut shape can be placed into the turbine blade platform, which can allow for even greater mechanical and thermal benefits that cannot be accomplished by simple machining.

An embodiment of the present invention also includes one or more cooling passages extending in a generally radial direction from the root 402 and into the airfoil 416. As one skilled in the art will understand, turbine blades are generally cooled, typically with air, in order to lower the overall metal temperature of the blade to withstand the harsh operating conditions of the turbine. While it is necessary to cool the interior of the turbine blades, it is also desirable to only use the minimum amount of air necessary, because the cooling air is taken from compressor discharge air and any air used for cooling does not pass through the combustion system, resulting in a lower overall efficiency.

Figure 12:
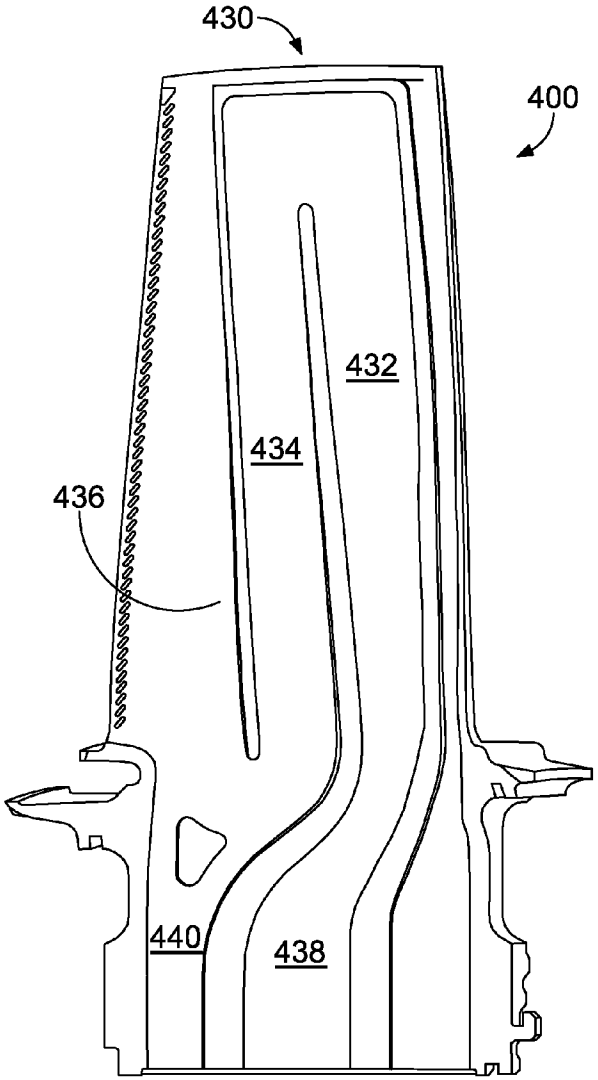

One way to maximize use of the cooling air is to incorporate a serpentine passageway in the airfoil, as shown in FIG. 12. Traditional serpentine cooling includes a three-pass cooling passageway fed by a single supply passage. In an embodiment of the present invention, the gas turbine blade 400 comprises a serpentine passageway 430 having a first passage 432, a second passage 434, and a third passage 436, each extending in a generally radial direction. A first supply passage 438 is in fluid communication with the first passage 432 and a second supply passage 440 is in fluid communication with the second and third passages 434 and 436, but because of the serpentine flow design, passage 440 does not supply air to passage 434 in this embodiment. This second supply passage 440, also known as a refresher passage, is necessary because it provides a source of lower temperature cooling air directly to the trailing edge region adjacent the third passage 436. In a traditional serpentine cooling arrangement, cooling air is supplied through only a first supply passage 438 and the volume of air that travels the entire serpentine cooling passage picks up heat as it passes to the trailing edge.

Figure 10:
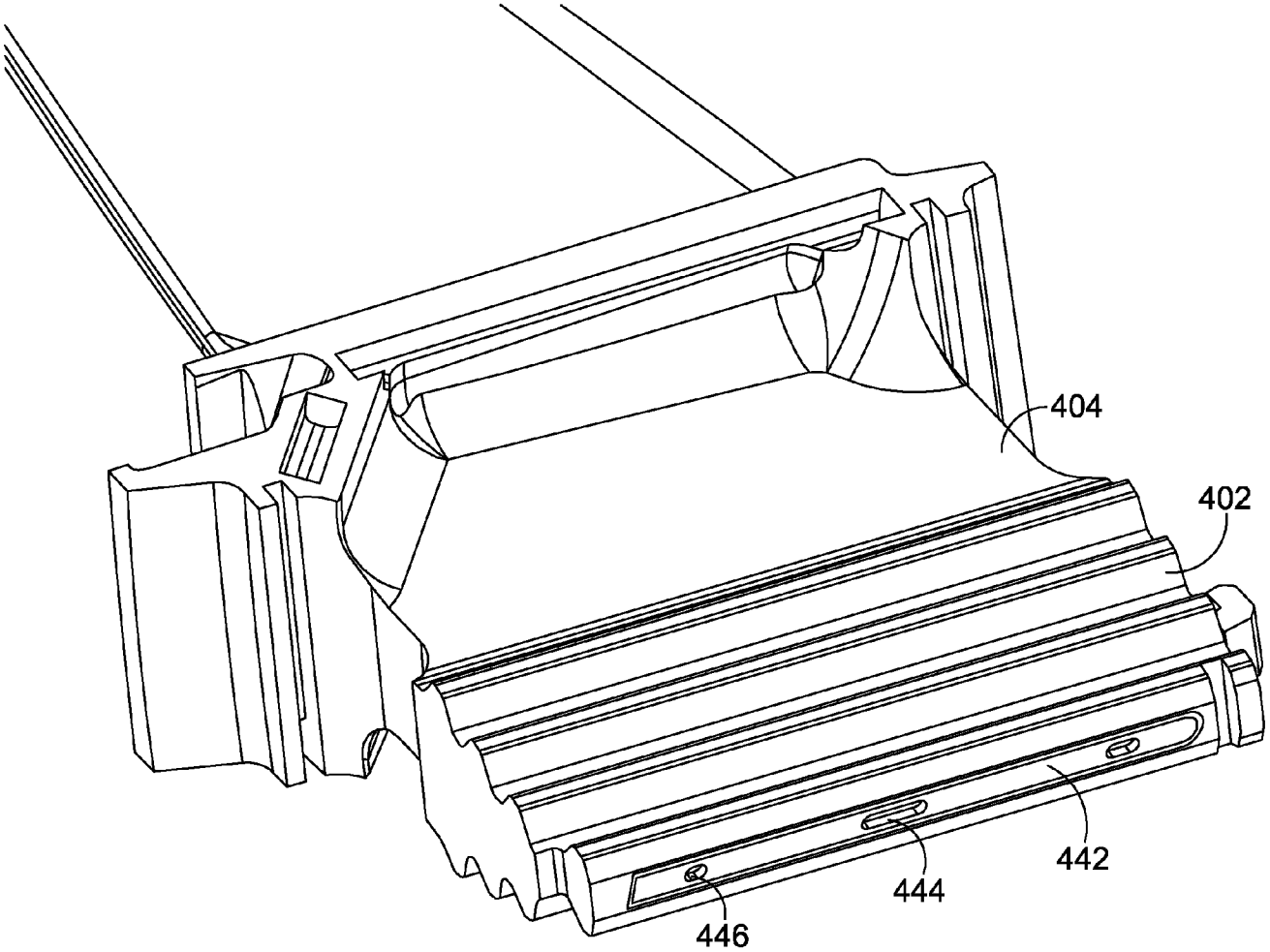
FIG. 10 depicts a perspective view of the root portion of the turbine blade in accordance with an embodiment of the present invention.

To further control the amount of cooling air entering the cooling passages 438 and 440, a meterplate 442 is attached to the radially inner surface of blade root 402, as shown in FIG. 10. A first opening 444 in the meterplate 442 is sized accordingly to permit the required airflow into the first supply passage 438 while a second opening 446 is sized accordingly to permit the required airflow into the second supply passage 440.

Each of the improvements described above (new undercut and supplying air to the second and third passage of the serpentine) individually offer some improvement to the area of concern, the trailing edge of the turbine blade, by reducing stress and lowering operating temperatures as shown in Table 1 below.

TABLE 1

| | Undercut Only | Cooling Air Only | Undercut and Cooling Air |
|---|---|---|---|
| Stress (% change) | −35.7% | −2.2% | −37.5% |
| Temperature (% change) | 0% | −3.8% | −4.8% |
| LCF (% change) | +222% | +75% | +769% |

In an embodiment of the invention only utilizing undercuts 418 and 420, the trailing edge stresses are reduced by approximately 35%, but there is no impact on the local temperature. This change by itself provides a 222% improvement in LCF life over the prior art, where the design life is measured in terms of LCF, or low cycle fatigue, where LCF is the number of loading cycles to failure for a part. In an embodiment of the invention, where only the additional cooling air is provided via the second supply passage 440 stress in the trailing edge drops only slightly, approximately 2%, but temperatures drop approximately 3.8% resulting in LCF improvement of approximately 75%. The maximum benefit is realized when both the first and second undercuts 418 and 420 are placed in the platform and the second and third passages of the serpentine are supplied with air from the second supply passage 440. When both improvements are utilized together, maximum stress in the area of concern drops by approximately 37%, the maximum operating temperature drops approximately 4.8%, and the predicted design life increases approximately 769%.

While the benefits discussed above are associated with the configuration of the turbine blade 400, the specific benefits of the undercut versus the additional cooling will vary depending on the turbine blade configuration.

The present invention has been described in relation to particular embodiments, which are intended in all respects to be illustrative rather than restrictive. Alternative embodiments will become apparent to those of ordinary skill in the art to which the present invention pertains without departing from its scope.

From the foregoing, it will be seen that this invention is one well adapted to attain all the ends and objects set forth above, together with other advantages which are obvious and inherent to the system and method. It will be understood that certain features and sub-combinations are of utility and may be employed without reference to other features and sub-combinations. This is contemplated by and within the scope of the claims.

What is claimed is:

1. A gas turbine blade comprising:
a root;
a platform extending radially outward from the root, the platform having opposing leading edge and trailing edge faces separated by a length, and a pressure side face and a suction side face spaced apart by a width;
an airfoil extending radially outward from the platform;
a first undercut positioned along the pressure side face of the platform and extending to an intersection point in a region adjacent the trailing edge face of the platform; and,
a second undercut positioned along the suction side face of the platform and extending to the intersection point in the region adjacent the trailing edge face of the platform.

2. The gas turbine blade of claim 1, wherein the platform further comprises a recessed region positioned along a portion of the pressure side face.

3. The gas turbine blade of claim 1, wherein the airfoil includes one or more cooling passages.

4. The gas turbine blade of claim 1, wherein the first undercut has a first cut angle of approximately 20-25 degrees projecting towards the pressure side face of the platform.

5. The gas turbine blade of claim 4, wherein the second undercut has a second cut angle of approximately 5-15 degrees projecting towards the suction side face of the platform.

6. The gas turbine blade of claim 1, wherein the first and second undercuts are machined into the platform.

7. The gas turbine blade of claim 1, wherein the first and second undercuts intersect in a region adjacent a trailing edge of the airfoil forming a wall thickness between the undercuts and an internal cooling passage of at least 0.125 inches.

8. A gas turbine blade comprising:
a root;
a platform extending radially outward from the root, the platform having opposing leading edge and trailing edge faces separated by a length, and a pressure side face and a suction side face spaced apart by a width;
an airfoil having at least a serpentine passageway comprising a first passage, second passage, and a third passage, a first supply passage in fluid communication with the first passage, and a second supply passage in fluid communication with the second and third passages;
a first undercut positioned along the pressure side face of the platform and extending to an intersection point in a region adjacent the trailing edge face of the platform; and,
a second undercut positioned along the suction side face and extending to the trailing edge face of the platform and intersecting the first undercut.

9. The gas turbine blade of claim 8, wherein the platform further comprises a recessed region positioned along a portion of the pressure side face.

10. The gas turbine blade of claim 8, wherein the airfoil includes a plurality of cooling passages.

11. The gas turbine blade of claim 8, wherein the first undercut has a first cut angle projecting towards the pressure side face of approximately 20-25 degrees.

12. The gas turbine blade of claim 11, wherein the second undercut has a second cut angle projecting towards the suction side face of approximately 5-15 degrees.

13. The gas turbine blade of claim 8, wherein the first and second undercuts are machined into the platform.

14. The gas turbine blade of claim 8, wherein the first and second undercuts intersect in a region adjacent a trailing edge of the airfoil forming a wall thickness of at least 0.125 inches.

* * * * *